United States Patent [19]

Sudweeks et al.

[11] Patent Number: 4,867,920

[45] Date of Patent: Sep. 19, 1989

[54] EMULSION EXPLOSIVE MANUFACTURING METHOD

[75] Inventors: Walter B. Sudweeks, Orem; Lawrence D. Lawrence, Sandy, both of Utah

[73] Assignee: Ireco Incorporated, Salt Lake City, Utah

[21] Appl. No.: 257,813

[22] Filed: Oct. 14, 1988

[51] Int. Cl.[4] ..... C41B 21/00

[52] U.S. Cl. ..... 264/3.1; 149/2; 149/109.6; 264/3.3

[58] Field of Search ..... 149/2, 109.6; 264/3.1, 264/3.3

[56] References Cited

U.S. PATENT DOCUMENTS

| | | | |
|---|---|---|---|
| 4,008,108 | 2/1977 | Chrisp | 149/2 |
| 4,138,281 | 2/1979 | Olney et al. | 149/2 |
| 4,142,928 | 3/1979 | Stewart | 149/2 |
| 4,218,272 | 8/1980 | Brockington | 149/2 |
| 4,322,258 | 3/1982 | Sudwecks et al. | 149/2 |
| 4,490,195 | 12/1984 | Cooper et al. | 149/2 |
| 4,500,369 | 2/1985 | Tag et al. | 149/2 |
| 4,547,232 | 10/1985 | Cartwright | 149/2 |
| 4,555,276 | 11/1985 | Winston | 149/2 |
| 4,790,890 | 12/1988 | Miller | 149/2 |

*Primary Examiner*—Stephen J. Lechert, Jr.

[57] ABSTRACT

The present invention provides a means by which chemically or thermally gassed emulsion explosives can be packaged in symmetrical cartridges, such as cylindrical paper packages having crimped ends. After formation, the gassed emulsion explosive is formed into a continuous strip of generally constant width and height. The strip then is passed through a cooling bath to cool the emulsion explosive to a predetermined temperature. A desired length of emulsion then is cut from the cooled strip, and the cut length is wrapped with a paper packaging material to form a cartridge of emulsion explosive.

10 Claims, 1 Drawing Sheet

EMULSION EXPLOSIVE MANUFACTURING METHOD

The present invention relates to packaged explosives and methods of manufacture thereof and more particularly to a method of manufacturing packaged emulsion explosives. The term "emulsion" as hereafter used shall mean an oil-continuous emulsion having a continuous organic fuel phase and a discontinuous oxidizer solution phase dispersed as fine droplets throughout the fuel phase. The term "explosive" shall mean a detonable composition which can be either cap-sensitive or non-cap-sensitive, as desired. The term "packaged" shall refer to cylindrical tubes or sticks of emulsion explosive of any desired length and having a diameter of generally 50 mm or less, although larger diameter products also can be made by the methods described herein.

BACKGROUND OF THE INVENTION

Emulsion explosives are well-known in the art; see, for example, U.S. Pat. Nos. 4,356,044; 4,322,258; 4,141,767; and 3,161,551. They generally are formed at elevated temperatures, which are necessary to form the solution of oxidizer salt(s) in water. It has been found, however, that once the emulsion explosive is formed at the elevated temperature, it should be cooled rapidly to ambient temperature in order to preserve its long-term storage stability. Moreover, where such emulsion explosives are chemically gassed for sensitivity purposes, the formulated emulsion should be cooled quickly to minimize shrinkage or potential coalescence of the chemically generated gas bubbles within the emulsion. Accordingly, in forming chemically gassed, packaged emulsion explosives, it is desirable to cool each stick package as quickly as possible.

Packaged explosives have been manufactured for many years. For example, dynamites have been paper-wrapped in conventional machines to form symmetrical cylindrical sticks having crimped or "squared" ends that form planer surfaces perpendicular to the axis of the cylindrical stick. Packages in this form are convenient for handling, and when loaded into boreholes, have good end-to-end contact which facilitates stick-to-stick propagation of a detonation. Aqueous slurry explosives, which comprise a thickened gel of oxidizer salt solution throughout which a fuel is dispersed or dissolved, primarily have been packaged in a sausage-like form in a flexible tubing such as polyethylene having clipped ends. A process and apparatus for packaging slurry explosives in a sausage-like form is described in U.S. Pat. No. 3,783,735. The clipped ends, however, tend to interfere with close end-to-end contact, and thus clipped polyethylene tubes are not as desirable in certain applications as crimped paper tubes in assuring reliable detonation propagation from stick to stick in a loaded borehole. More recently, emulsion explosives have been packaged either in crimped paper tubes, similar to that used for packaging dynamite, or in sausage-like clipped tubes, similar to that used for packaging slurry explosives. Thus for certain applications and for the reasons set forth above, it is desirable to package emulsion explosives in symmetrical paper-wrapped cylinders having squared ends formed by crimping or other means.

Emulsion explosives generally require some form of uniform distribution of gas bubbles for adequate detonation sensitivity. A common method of introducing sensitizing gas bubbles is incorporating a uniform distribution of void containing materials, such as glass or organic microspheres or perlite, throughout the emulsion. These void containing materials will not tend to migrate or coalesce once dispersed throughout the emulsion, and therefore, packaging of emulsions containing these materials is relatively simple.

Another means of sensitizing emulsion explosives is by the introduction of ingredients which react chemically to produce gas bubbles. Chemical gassing is a less expensive means of sensitization than the use of hollow microspheres and is therefore preferred from a cost standpoint. These free, discrete gas bubbles tend to shrink and/or coalesce in the emulsion or escape from the emulsion, however, unless inhibited by the viscosity of the emulsion itself. Because emulsions are relatively fluid at their elevated temperatures, it is important to cool them quickly and render them sufficiently viscous to minimize these problems. Heretofore, gassed emulsion explosives have been manufactured in sausage-like packages that are filled and cooled quickly to prevent gas bubble coalescense. Further, if the emulsion can be cooled prior to packaging, the tacky nature of a hot emulsion can be reduced, thus making the packaging step much easier. Paper wrapping of gassed emulsion in conventional equipment, such as a Rollex machine manufactured by Maschinenfabrik Fr. Neipmann GmbH & Co., has not been possible, since a means for cooling a hot gassed emulsion has not been available. The method of present invention accomplishes, among other things, the critical precooling step.

An additional problem with gassed emulsions is that they tend to shrink in volume as they cool from their elevated formulation temperatures. This is because the volume of an individual gas bubble decreases as the temperature decreases. Thus if gassed emulsions are paper wrapped at their elevated formulation temperatures, undesirable shrinkage within the paper package would occur upon cooling. If the emulsion can be cooled prior to packaging, then this shrinkage problem is eliminated.

Copending and commonly assigned U.S. Ser. No. 128,097 discloses a novel method and apparatus for packaging gassed emulsions. Disclosed herein is another novel method for packaging gassed emulsions, which method can be used with conventional packaging equipment.

SUMMARY OF THE INVENTION

The present invention provides a means by which chemically or thermally gassed emulsion explosives can be packaged in symmetrical cartridges, such as cylindrical paper packages having crimped ends. This is accomplished with minimal migration and coalescence of the gas bubbles and consequent loss of detonation sensitivity. Product shrinkage within the package also is minimized since the product is cooled prior to packaging. More specifically, the methods of the present invention provide for cooling of the gassed emulsion prior to final packaging. After formation, the gassed emulsion explosive is formed into a continuous strip of generally constant width and height. The strip then is passed through a cooling bath to cool the emulsion explosive to a predetermined temperature. A desired length of emulsion then is cut from the cooled strip, and the cut length is wrapped with a paper packaging material to form a cartridge of emulsion explosive.

In addition to working with chemically or thermally gassed emulsion explosives, the methods of the invention also allow for packaging of emulsion explosives that are gassified by entrainment of gas bubbles during mixing of the emulsion or by dissolving a gas under pressure in either the oxidizer solution or fuel phase of the emulsion, which dissolved gas then effervesces upon return to ambient pressure. Although the methods of the invention are particularly advantageous for packaging emulsion explosives sensitized by chemically or thermally generated gas bubbles, such methods can also be used to package emulsion explosives sensitized by void containing materials or combinations of such materials with chemically or thermally generated gas bubbles.

DETAILED DESCRIPTION OF THE INVENTION

Figure 1:
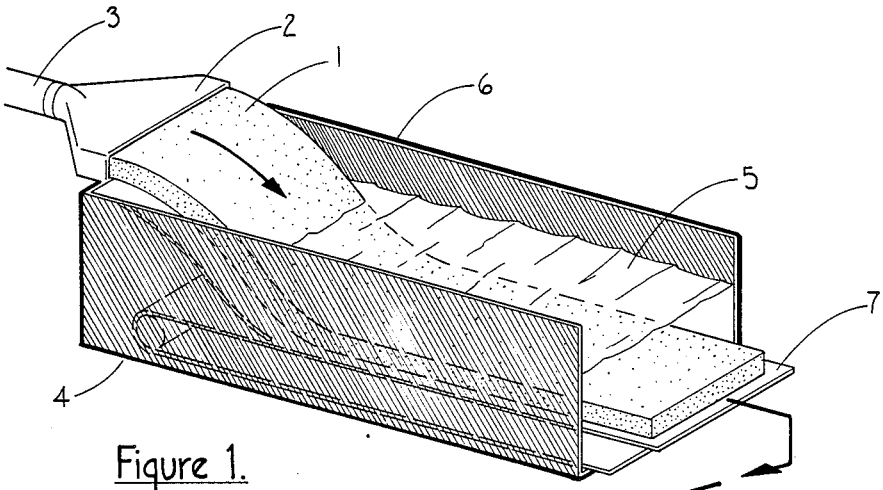
FIG. 1 is a perspective, partially cut away view of a strip or slab of emulsion explosive entering a cooling bath by means of a conveyor belt.

The drawings (not drawn to scale) show an illustrative embodiment of the method of the present invention, wherein in FIG. 1 a strip 1 of emulsion explosive exits from a dimensioning nozzle 2 (and enters the nozzle 2 by means of a conduit 3 which leads from an emulsion manufacturing source not shown) and enters a cooling bath 4, comprising a cooling liquid 5 contained within a trough 6. The strip 1 is propelled through the cooling bath 4 in the direction shown by means of a conveyor belt 7. The dimensioning nozzle 2 forms the emulsion explosive into a continuous strip 1 of desired width and height.

Figure 2:
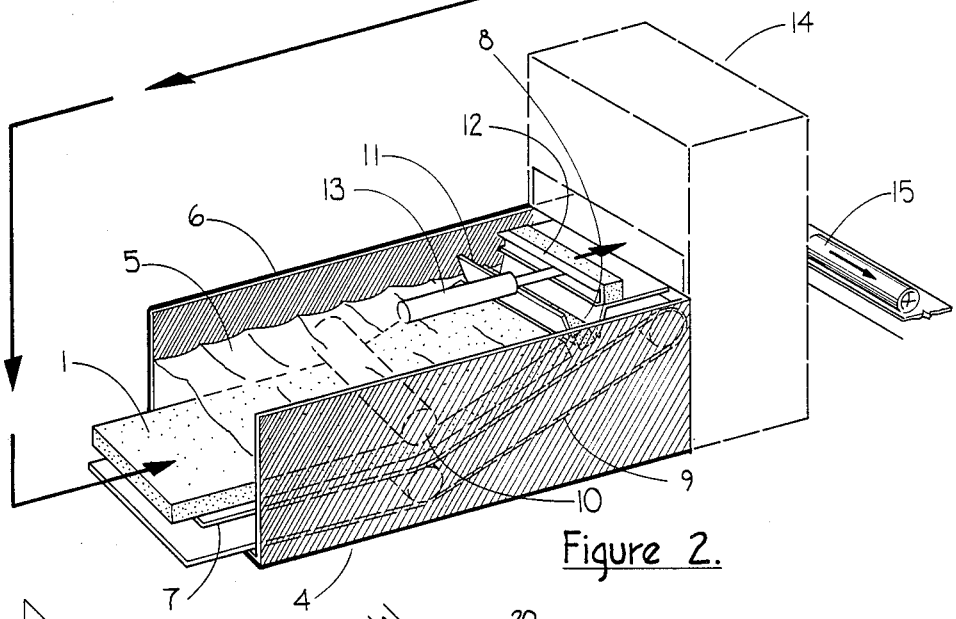
FIG. 2 is a perspective, partially cut away view of a strip of emulsion explosive exiting a cooling bath by means of a conveyor belt and entering a cutting and wrapping element.

In FIG. 2, the strip 1 is shown exiting the cooling bath 4 at point 8 by means of an inclined conveyor belt linkage 9. Dimensioning roller 10 further modifies the width and height of the strip 1. A cutting blade 11 cuts off a desired length 12 of explosive which is lifted from the bath 4 by the cutting blade 11 and then is forced by means of a pusher arm 13 into a wrapping assembly 14, in which the length 12 of explosive is wrapped with a paper packaging material to form a cartridge 15 of emulsion explosive.

Figure 3:
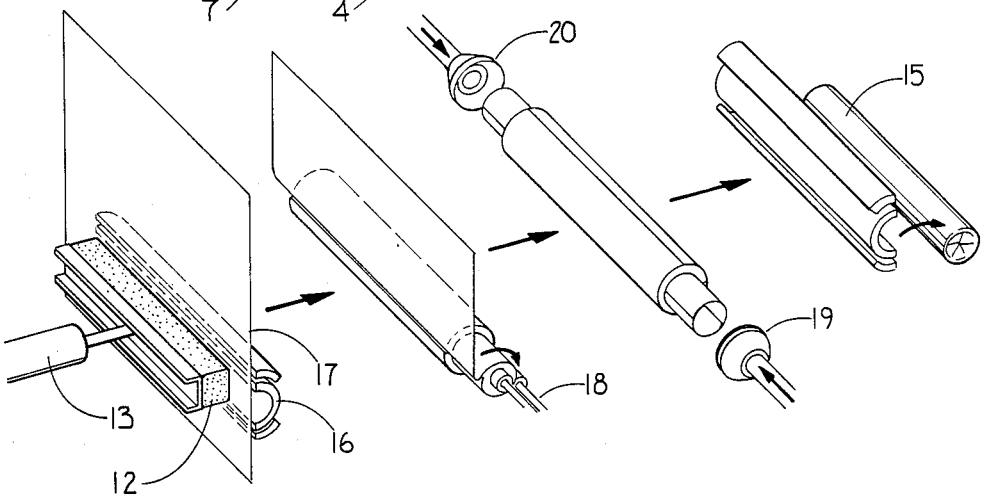
FIG. 3 is a perspective, partially cut away series of views showing the various steps in wrapping a cut length of explosive into a cylindrical package having crimped ends.

FIG. 3 shows the separate steps involved in wrapping a length 12 of emulsion explosive. The left figure shows the length 12 of explosive being pushed by the pusher arm 13 into a shell 16 which forms around and cylindrically shapes the length 12. Interposed between the length 12 and shell 16 is a paper packaging material 17. The next figure to the right shows the shell 16 forming around the length 12 and the rollers 18 wrapping the paper material 17 around the cylindrical explosive. The next figure to the right shows reciprocating crimping caps 19 and 20 which crimp the ends of the paper-wrapped cartridge 15. The figure on the right shows the cartridge 15 being released from the shell.

The compositions of the packaged emulsion explosives comprise an immiscible organic fuel forming the continuous phase of the composition in an amount generally from about 3% to about 12% by weight of the composition; emulsifying agent; inorganic oxidizer salt solution (or melt) forming the discontinuous phase of the composition, generally comprising inorganic oxidizer salt in an amount from about 45% to about 95%; and water and/or water-miscible organic liquids preferably in an amount of from about 2% or less to about 15%. Optionally, the compositions can be formulated without any water. The "water-in-oil" emulsifying agent is employed generally in an amount of from about 0.1% to about 5% by weight. Preferred organic fuels are mineral oil, No. 2 fuel oil, paraffin waxes, microcrystalline waxes and mixtures thereof. The oxidizer salts are selected from the group consisting of ammonium, alkali and alkaline earth metal nitrates, chlorates and perchlorates. Ammonium nitrate is usually the predominant oxidizer salt, and lesser amounts of sodium nitrate or calcium nitrate are commonly used. A portion of the total oxidizer salt may be added in particle or prill form.

The packaged explosives are reduced from their natural densities by addition of a density reducing agent(s) in an amount sufficient to decompose and reduce the density to within the range of from about 0.9 to about 1.4 g/cc. Although glass or organic microspheres, perlite or other void containing materials can be used as the density reducing agent or part thereof, the methods of the present invention are particularly advantageous with respect to density reduction by means of chemical or thermal gassing, entrainment or pressurized dissolution, as previously described, either alone or in combination with void containing materials.

The packaging material preferably is selected from the group consisting of paper, coated paper (wax, polymer, etc.) and laminates of plastic and paper. Various packaging machines such as a Rollex machine are well-known in the art. The actual apparatus employed is not critical and can be readily selected or designed by those skilled in the art.

The emulsion explosives may be formulated in a conventional manner. Typically, the oxidizer salt(s) first is dissolved in the water (or aqueous solution of water and miscible liquid fuel) at an elevated temperature of from about 25° C. to about 110° C. or higher, depending upon the crystallization temperature of the salt solution. The aqueous solution then is added to a solution of the emulsifying agent and the immiscible liquid organic fuel, which solutions preferably are at the same elevated temperature, and the resulting mixture is stirred with sufficient vigor to produce an emulsion of the aqueous solution in a continuous liquid hydrocarbon fuel phase. Usually this can be accomplished essentially instantaneously with rapid stirring. (The compositions also can be prepared by adding the liquid organic to the aqueous solution.) Stirring should be continued until the formulation is throughout the formulation by conventional means. The gassing agents then are added and uniformly mixed throughout the formulation. These agents react or decompose to produce finely dispersed gas bubbles. The formulation process also can be accomplished in a continuous manner as is known in the art. The gassed emulsion then is formed into a continuous strip of generally constant width and height, with the width preferably ranging from about 75 mm to about 400 mm and the height preferably ranging from about 20 mm to about 45 mm.

The continuous strip then is fed into a cooling bath, which preferably is water or an aqueous salt solution at a temperature of preferably from about 2° C. to about 30° C. The cooling bath can be an elongated trough of up to 100 m or more in length. The strip preferably is cooled to a center or core temperature of from about 5° C. to about 40° C. This generally can be accomplished in about 5 to 30 minutes of cooling time. The cooled strip then is fed into a cutting device wherein a desired length is cut from the strip, preferably while the strip still is submerged to utilize the lubricating properties of the cooling medium. This lubrication prevents the emulsion from adhering to the mechanical parts. The length essentially is in the form of a square-shaped rod, which then is fed into a paper packaging device which shapes and wraps the cut length with paper to form a cylindrical cartridge of emulsion explosive. The cartridge preferably is in the form of a cylindrical rod, and the ends of the paper wrapper preferably are crimped. The sizes of the cartridge can vary as desired but preferably are in the ranges of from about 20 mm to about 45 mm in diameter and from about 75 mm to about 400 mm in length (which is the width of the strip).

The present invention further is illustrated by the following examples in the Table, which are prepared in accordance with the above-described methods.

The process parameters for the examples are as follows:

1. The emulsion is formed at an elevated temperature of 90° C.
2. The cooling bath is maintained at a temperature of 5° C.
3. The continuous strip width and height prior to packaging are 400 mm and 32 mm respectively, which dimensions also correspond to the final cartridge length and diameter, respectively.
4. The residence time in the bath is 20 minutes.
5. The cartridges in Examples A and B are wrapped with conventional manila paper used for packaging dynamite.

The compositions in the examples have the detonation properties set forth in the Table.

The packaged emulsion explosives of the present invention can be used conventionally, and thus they can be used in most applications where other packaged products, such as dynamites are used.

While the present invention has been described with reference to certain illustrative examples and preferred embodiments, various modifications will be apparent to those skilled in the art and any such modifications are intended to be within the scope of the invention as set forth in the appended claims.

TABLE

| Composition Ingredients (parts by weight) | A | B |
|---|---|---|
| Ammonium Nitrate | 69.18 | 67.86 |
| Calcium Nitrate | 13.14 | 12.89 |
| Water | 11.57 | 11.35 |
| Emulsifying Agent[a] | 1.45 | 1.42 |
| Oil[b] | 0.26 | 2.09 |
| Wax[c] | 4.00 | 2.09 |
| Gassing Agent[d] | 0.40 | 0.30 |
| Microballoons[e] | — | 2.00 |

TABLE-continued

| Composition Ingredients (parts by weight) | A | B |
|---|---|---|
| Density (g/cc) | 1.15 | 1.10 |
| Detonation Results (5° C.) | | |
| Minimum Booster, 32 mm[f] | 3/2 | 3/2 |
| Detonation Velocity (km/sec) | 4.5 | 4.7 |

[a]Sorbitan monooleate
[b]Mineral oil
[c]Microcrystalline wax
[d]Sodium nitrite/catalyst solution
[e]B23/500s from 3M Company
[f]The first number indicates a detonation with the cap number listed. The second number indicates a failure with the cap number listed. The cap number indicates the number of grains of PETN in the base charge.

What is c aimed is:

1. A method of paper-wrapping a gassed emulsion explosive consisting essentially of (a) forming an oil-continuous emulsion at an elevated temperature, (b) incorporating a sensitizing, uniform distribution of gas bubbles into the emulsion to form an emulsion explosive, (c) forcing the emulsion explosive into a continuous strip of generally constant width and height, (d) passing the strip through a cooling bath to cool the emulsion explosive to a predetermined temperature, (e) cutting a desired length of emulsion explosive from the strip, and (f) wrapping the cut length with a paper packaging material to form a cartridge of emulsion explosive.

2. A method according to claim 1 wherein the oil-continuous emulsion comprises droplets of oxidizer solution or melt dispersed within a continuous fuel phase and the emulsion is formed at a temperature above the crystallization temperature of the oxidizer solution.

3. A method according to claim 2 wherein the continuous fuel phase is selected from the group consisting of mineral oil, No. 2 fuel oil, vegetable oils, paraffin waxes, microcrystalline waxes and mixtures thereof.

4. A method according to claim 1 wherein the gas bubbles are incorporated by means of a gassing agent that decomposes in the emulsion to produce gas bubbles.

5. A method according to claim 1 wherein the gas bubbles are incorporated by mechanical entrainment into the emulsion.

6. A method according to claim 1 wherein the gas bubbles are incorporated by dissolving the gas under pressure in either the oxidizer solution or fuel phase, which dissolved gas then effervesces upon return to ambient pressure.

7. A method according to claim 2 wherein the center or core of the strip of emulsion explosive is cooled in a bath to a temperature of from about 5° C. to about 40° C.

8. A method according to claim 7 wherein the cooling bath is water or an aqueous solution at a temperature of at least 5° C. below the desired final temperature of the cooled emulsion explosive.

9. A method according to claim 1 wherein the gas bubbles are contained within void containing materials that are distributed throughout the emulsion.

10. A method according to claim 1 wherein the gas bubbles are a combination of chemically or thermally generated bubbles and bubbles contained within void containing materials that are distributed throughout the emulsion.

* * * * *